US009772144B2

(12) United States Patent
Day

(10) Patent No.: US 9,772,144 B2
(45) Date of Patent: Sep. 26, 2017

(54) HEAT EXCHANGER HAVING A REINFORCED COLLECTOR

(71) Applicant: Valeo Systemes Thermiques, Le Mesnil Saint Denis (FR)

(72) Inventor: Alan Day, Reims (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 238 days.

(21) Appl. No.: 14/402,995

(22) PCT Filed: May 16, 2013

(86) PCT No.: PCT/EP2013/060180

§ 371 (c)(1),
(2) Date: Nov. 21, 2014

(87) PCT Pub. No.: WO2013/174719

PCT Pub. Date: Nov. 28, 2013

(65) Prior Publication Data

US 2015/0176922 A1 Jun. 25, 2015

(30) Foreign Application Priority Data

May 24, 2012 (FR) ..... 12 54743

(51) Int. Cl.
*F28F 9/02* (2006.01)
*F28F 3/02* (2006.01)
*F28D 21/00* (2006.01)

(52) U.S. Cl.
CPC ..... *F28F 3/025* (2013.01); *F28F 9/027* (2013.01); *F28F 9/0226* (2013.01); *F28D 2021/0082* (2013.01)

(58) Field of Classification Search
CPC ..... F28F 9/0219; F28F 9/001; F28F 9/002; F28F 9/02; F28F 9/0224; F28F 9/0226;
(Continued)

(56) References Cited

U.S. PATENT DOCUMENTS 4,234,041 A * 11/1980 Melnyk ..... F28F 9/02 165/173
4,332,293 A 6/1982 Hiramatsu
(Continued)

FOREIGN PATENT DOCUMENTS

DE 200 16 331 U1 2/2002
DE 10 2011 013 043 A1 9/2011
(Continued)

OTHER PUBLICATIONS

International Search Report for Application No. PCT/EP2013/060184 dated Jun. 17, 2013, 5 pages.
(Continued)

*Primary Examiner* — Davis Hwu
(74) *Attorney, Agent, or Firm* — Howard & Howard Attorneys PLLC

(57) ABSTRACT

A heat exchanger includes a heat exchange body 2, at least one cover 4 and a manifold 3 connecting the cover 4 to the heat exchange body 2. The heat exchange body 2 is delimited by at least one blanking plate 6. The manifold 3 includes a base plate 20 surrounded by an edge 21 for fixing the cover 4, and the fixing edge 21 is formed by a double-thickness wall 22, one end 23 of which is at least partially fixed to the blanking plate 6.

15 Claims, 3 Drawing Sheets

Figure 1:
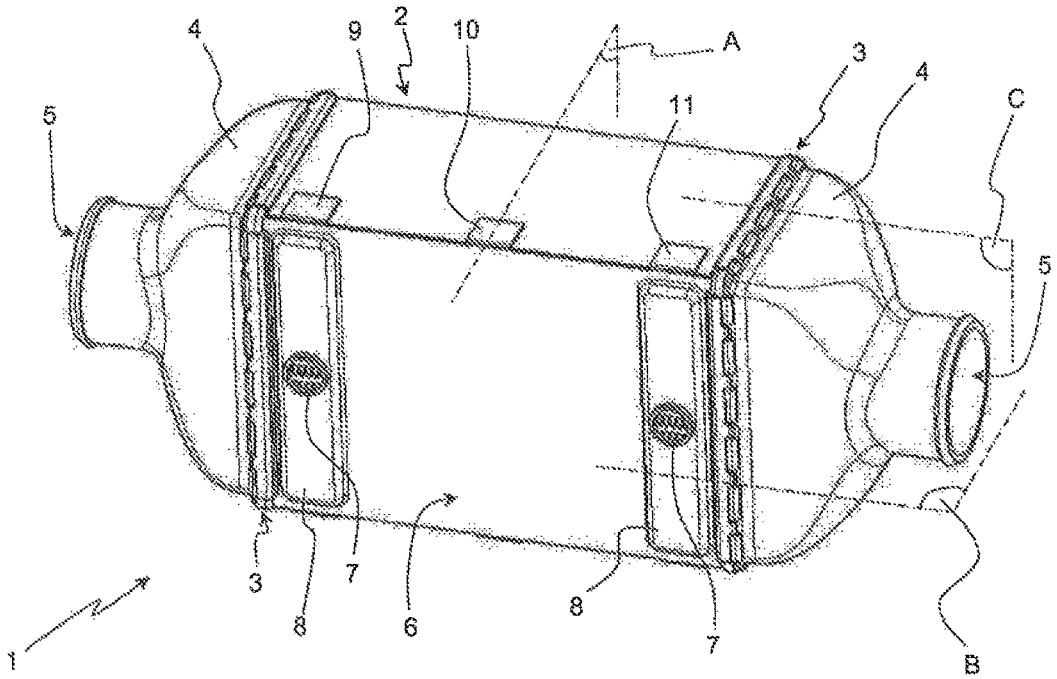

(58) Field of Classification Search
CPC ..... F28F 9/027; F28F 9/04; F28F 9/12; F28F 9/16; F28F 9/18; F28F 9/24; F28F 13/06; F28F 21/084; F28F 2220/00; F28F 2265/10; F28F 2265/12; F28F 2275/04; F28F 2275/06; F28F 2275/08; F28F 2275/14; F28F 2021/0049
See application file for complete search history.

(56) References Cited

U.S. PATENT DOCUMENTS

| | | | | |
|---|---|---|---|---|
| 5,758,721 | A | 6/1998 | Letrange et al. | |
| 8,800,642 | B2 | 8/2014 | Ninagawa et al. | |
| 2003/0217838 | A1* | 11/2003 | Dey | F28D 1/0535 165/173 |
| 2010/0059215 | A1 | 3/2010 | Kolb et al. | |
| 2011/0168370 | A1* | 7/2011 | Garret | F28D 7/1684 165/158 |
| 2011/0277954 | A1 | 11/2011 | Pautler | |
| 2012/0018135 | A1* | 1/2012 | Ciaffarafa | B21D 39/02 165/173 |
| 2013/0146267 | A1 | 6/2013 | Garret et al. | |

FOREIGN PATENT DOCUMENTS

| | | | |
|---|---|---|---|
| EP | 0 779 490 | A1 | 6/1997 |
| FR | 2 254 771 | A1 | 7/1975 |
| FR | 2 742 531 | A1 | 6/1997 |
| GB | 1 484 510 | | 9/1977 |
| JP | H 03-225197 | A | 10/1991 |
| JP | 2004-125333 | A | 4/2004 |
| WO | WO 2011/073038 | A1 | 6/2011 |
| WO | WO 2013/174720 | A1 | 11/2013 |

OTHER PUBLICATIONS

International Search Report for Application No. PCT/EP2013/060180 dated Jun. 20, 2013, 7 pages.
Machine-Assisted English translation for DE 200 16 331 extracted from espacenet.com database on Dec. 10, 2014, 17 pages.
English language abstract for DE 10 2011 013 043 extracted from espacenet.com database on Dec. 10, 2014, 3 pages.
English language abstract for EP 0 779 490 extracted from espacenet.com database on Dec. 10, 2014, 2 pages.
English language abstract not found for FR 2 254 771; however, see English language equivalent GB 1,484,510. Original document extracted from espacenet.com database on Dec. 10, 2014, 8 pages.
English language abstract not found for FR 2 742 531; however, see English language equivalent U.S. Pat. No. 5,758,721. Original document extracted from espacenet.com database on Dec. 10, 2014, 18 pages.
English language abstract for JPH 03-225197 extracted from PAJ database on Dec. 10, 2014, 1 page.
English language abstract and machine-assisted English translation for JP 2004-125333 extracted from the PAJ database on Dec. 10, 2014, 15 pages.
English language abstract for WO 2011/073038 extracted from espacenet.com database on Dec. 10, 2014, 1 page.
English language abstract and machine-assisted English translation for WO 2013/174720 extracted from espacenet.com database on Dec. 10, 2014, 27 pages.

* cited by examiner

HEAT EXCHANGER HAVING A REINFORCED COLLECTOR

RELATED APPLICATIONS

This application is the National Stage of International Patent Application No. PCT/EP2013/060180, filed on May 16, 2013, which claims priority to and all the advantages of French Patent Application No. FR 12/54743, filed on May 24, 2012, the content of which is incorporated herein by reference.

The technical field of the present invention is that of heat exchangers which are configured to implement an exchange of heat between a first fluid and a second fluid and are more particularly intended to be installed in a motor vehicle. Such a heat exchanger is for example a charge air cooler or an exhaust gas cooler, in particular a recirculated exhaust gas cooler.

A motor vehicle can conventionally be equipped with an internal combustion engine combined with a turbocharger. The latter increases the temperature of these intake gases, thereby impairing proper filling of the combustion chambers of the engine. For this reason, it is known to supplement this configuration with the addition of a heat exchanger, the function of which is to cool the intake gases before they enter these combustion chambers, thereby making it possible to increase the density of the intake gases.

Such a heat exchanger can comprise a plurality of tubes through which the intake gases flow, the space surrounding these tubes are flowed through by a cooling fluid. At the inlet or at the outlet of this exchanger, the intake gases are channeled through a cover secured to a manifold, the latter being configured to receive, in a sealed manner, the end of each tube through which the intake gases enter.

New supercharging techniques are emerging. It is thus known to combine the internal combustion engine with two or three turbochargers. This combination is accompanied by an increase in the pressure and temperature of the intake gases. The mechanical stresses to which supercharger exchangers are subjected become extremely large, since the pressure of the intake gases can reach 4 bar. The heat exchangers that are currently known are thus not suitable for resisting such pressure or temperature levels, and leaks can arise in particular at the joint that connects the cover to the manifold.

Document FR2742531A1 discloses a solution for reinforcing a peripheral edge of the manifold. Although it improves the situation, such a solution is not suitable for a heat exchanger between the intake gases or exhaust gases of the internal combustion engine and a liquid cooling fluid on account of the fact that the liquid fluid flows around the tubes and not inside the latter, as mentioned by said document. The management of the sealing with respect to the liquid fluid is thus different.

Moreover, the reinforcement solution proposed by said document is locally limited to the peripheral edge of the manifold. However, the increase in pressure and temperature brings about deformation and expansion phenomena that the prior art solution is unable to counteract in a satisfactory manner.

The aim of the present invention is thus to solve the above-described drawbacks mainly by reinforcing the peripheral edge of the manifold so as to provide a means of absorbing forces on a component of the heat exchange body, in particular on the blanking plate or plates which delimit the ducts through which the cooling fluid flows.

The subject of the invention is thus a heat exchanger comprising a heat exchange body, at least one cover and a manifold connecting the cover to the heat exchange body, the heat exchange body being delimited by at least one blanking plate, the manifold comprising a base plate surrounded by an edge for fixing the cover, characterized in that the fixing edge is formed by a double-thickness wall, one end of which is at least partially fixed to the blanking plate. The fixing of the end of the double-thickness wall to the blanking plate thus ensures absorption of mechanical forces, this helping significantly to increase the mechanical strength of the fixing edge with respect to stresses generated by the pressure or the temperature of the fluids that are able to flow through the exchanger according to the invention.

According to one aspect of the invention, the heat exchange body comprises a plurality of tubes secured to the manifold, in particular by their ends, and able to channel a first fluid, and also a multiplicity of ducts able to channel a second fluid, said ducts being formed between the tubes and delimited by at least the blanking plate.

According to a first feature of the invention, a thickness of the double-thickness wall is at least twice as large as a thickness of the base plate. Such an arrangement ensures sufficient absorption of forces for the pressures to which the heat exchanger according to the invention is subjected.

According to a second feature of the invention, the double-thickness wall is formed by a first wall and a second wall brazed to the first wall. According to a first alternative, the first and second wall are produced from one and the same metal sheet and connected together by a fold. According to a second alternative, the second wall is separated from the first wall and then attached to the latter prior to a brazing step.

The double-thickness wall comprises at least one corner at which a mechanical reinforcement device is formed. The latter avoids an increase, under the effect of the pressure, in the angular inclination formed between the two parts of the double-thickness wall which border the corner.

According to one exemplary embodiment, the mechanical reinforcement device is for example a chamfer formed at the corner of the first wall. Alternatively, this mechanical reinforcement device is in particular a fillet formed at the corner of the second wall.

It will be noted that this reinforcement device may also be formed by the combination of the chamfer and the fillet, formed on one or the other of the walls. Such an arrangement makes it possible to generate forms which combine in order to oppose the mechanical stresses.

According to another feature of the invention, the fixing edge, in particular the first wall, at least partially delimits a housing for receiving a heel of the cover, the housing furthermore being delimited by a band which peripherally extends the base plate.

In such a case, the first wall of the double-thickness wall may comprise a first strip forming a base of the housing and a first side wall laterally delimiting the housing, the first strip and the first side wall being connected by a chamfer.

According to a further feature of the invention, the second wall of the double-thickness wall may comprise a second strip brazed to the first strip and a second side wall brazed to the first side wall, the second strip and the second side wall being connected by a fillet at a distance from the chamfer. The fillet and the chamfer form in this case the mechanical reinforcement device, and such a distance between this fillet and this chamfer helps significantly to increase the mechanical integrity of the fixing edge.

The multiplicity of ducts is closed by a first blanking plate and advantageously by a second blanking plate, each blanking plate being secured to a lateral wall of each tube. This lateral wall forms an edge of the tube and extends in a plane parallel to a plane of extension of the blanking plate.

Advantageously, the end of the double-thickness wall comprises a bend positioned such that one face of the second wall of the double-thickness wall is brazed to the blanking plate. Such an arrangement makes it possible to increase the fixing area, in particular for brazing, between the double-thickness wall and the blanking plate.

In addition, one edge of the double-thickness wall may be fixed at least to a longitudinal wall of an end tube of the heat exchange body. With the double-thickness wall forming a belt around the heat exchange body, said wall is thus brazed to a first side of the heat exchange body, in the region of the blanking plate, and can be brazed to a second side, perpendicular to the first side, of the heat exchange body. This second side is in particular formed by an end tube delimiting the heat exchange body.

In one fixing example, the blanking plate comprises at least one tongue that is folded against and brazed to a longitudinal wall of the end tube of the heat exchange body. Although one edge of the blanking plate is brazed to the lateral wall of the end tube, such a structure makes it possible to increase the mechanical strength of the heat exchange body, along the blanking plate.

It will be noted that the blanking plate may comprise at least one orifice through which a second fluid is able to enter or exit the heat exchange body. The feeding of second fluid to the heat exchanger is thus ensured.

The invention can also cover a system for cooling intake gases or exhaust gases of an internal combustion engine, comprising a heat exchanger comprising any one of the features presented above, in which the first fluid is formed by the intake gases or exhaust gases of the internal combustion engine while the second fluid is formed by a liquid cooling fluid.

A first advantage according to the invention lies in the possibility of increasing the mechanical strength of the connection between the cover and the manifold in a simple manner without thereby increasing the manufacturing cost or the difficulty of assembling such an exchanger. In this way, a heat exchanger provided with a manifold with a double-thickness wall, the end of this wall being secured to a plate that delimits the duct or ducts for the second fluid to flow through, can resist high pressures and temperatures.

Figure 2:
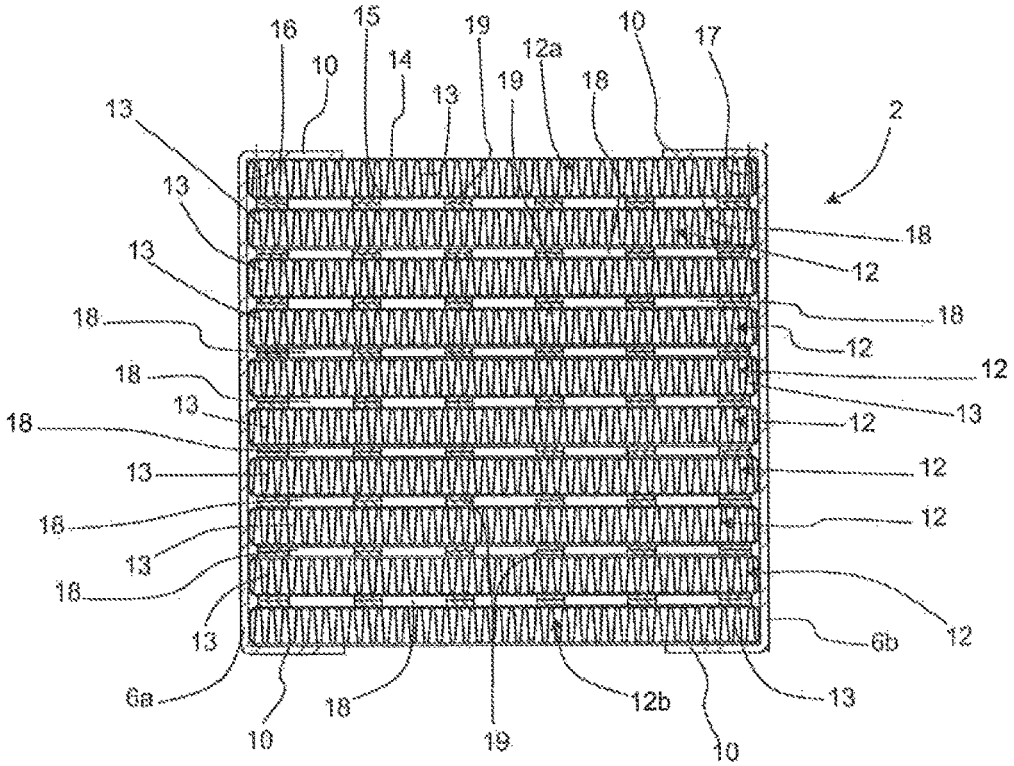
Figure 3:
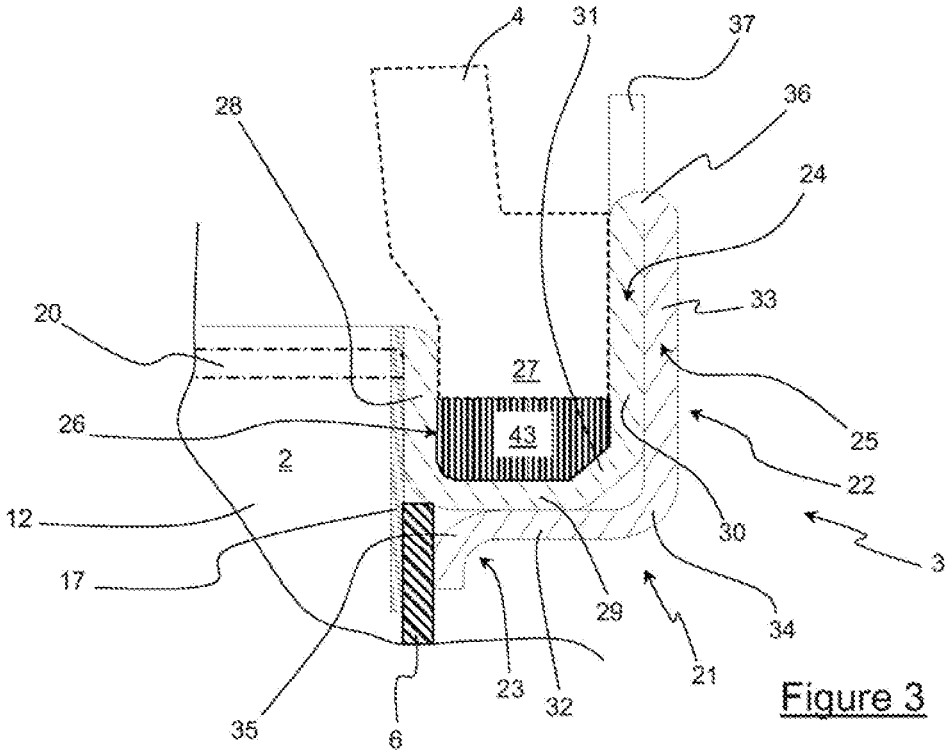
Figure 4:
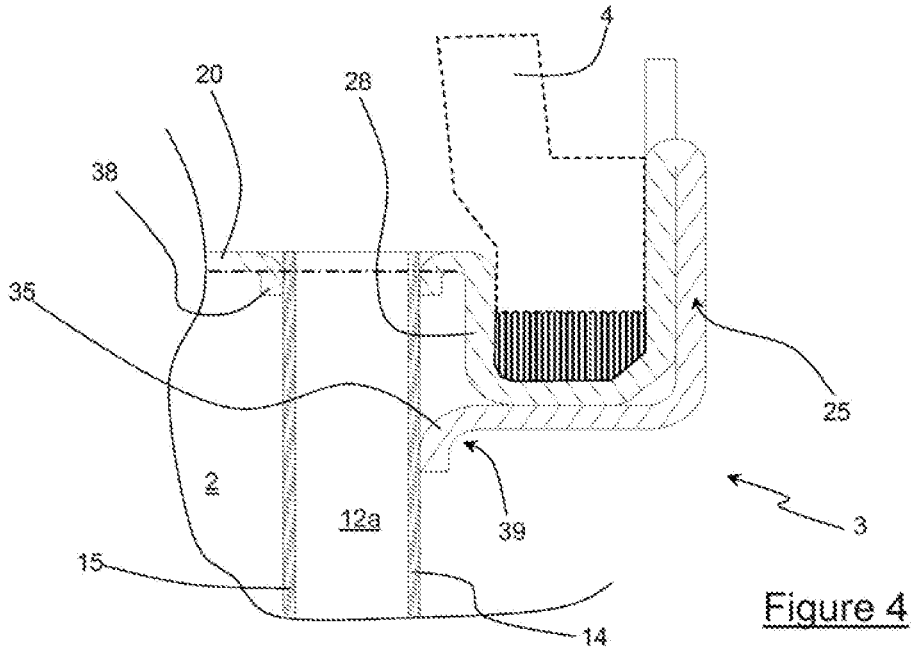
Figure 5:
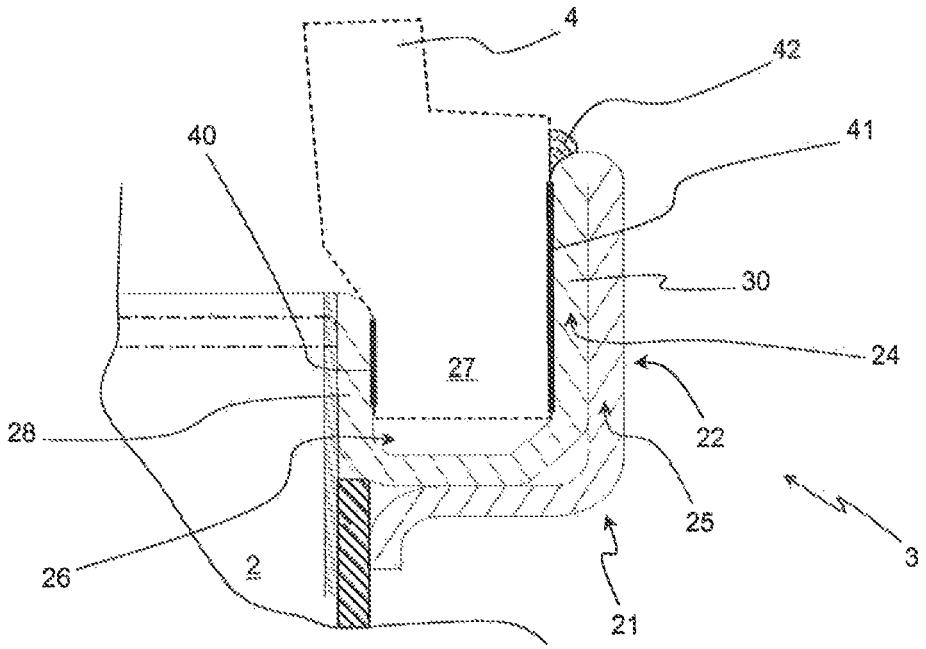

Further features, details and advantages of the invention will become more clearly apparent from reading the description given hereinbelow by way of illustration and with reference to the drawings, in which:

FIG. 1 is a perspective view of a heat exchanger according to the invention, FIG. 2 is a view of the constituent heat exchange body of the heat exchanger, in cross section on the plane A illustrated in FIG. 1, FIG. 3 is a view illustrating the fixing of the manifold to a first side of the heat exchange body, in cross section on the plane B illustrated in FIG. 1, FIG. 4 is a view illustrating the fixing of the manifold to a second side of the heat exchange body, in cross section on the plane C illustrated in FIG. 1, FIG. 5 is a view illustrating two variants of fixing between the manifold and the cover, viewed in cross section on the plane B shown in FIG. 1.

FIG. 1 illustrates an exemplary embodiment of a heat exchanger 1 according to the invention. Such a heat exchanger is in particular a charge air cooler used to cool the intake gases of an internal combustion engine, but it may also be a recirculated exhaust gas cooler used to lower the temperature of exhaust gas injected into the intake gases of such an internal combustion engine.

The heat exchanger 1 according to the invention is configured to implement an exchange of heat between a first fluid and a second fluid. In a particular manner, the heat exchanger is designed not only to channel a gaseous fluid but also to convey a liquid fluid, such as a cooling fluid consisting for example of water to which glycol has been added. Thus, the heat exchanger 1 may be a gaseous fluid/liquid fluid exchanger.

The heat exchanger 1 according to the invention comprises a heat exchange body 2 which forms the site of the heat exchange between the first fluid and the second fluid. Located at each end of this heat exchange body 2 is a manifold 3 covered by a cover 4.

The manifold 3 distributes the first fluid through a plurality of constituent tubes of the heat exchange body 2, this first fluid being channeled through the cover 4 to or from the manifold 3. The cover 4 comprises at least one opening 5 through which the first fluid enters or exits the heat exchanger 1. The manifold 3 is thus on one side brazed to the heat exchange body 2 and on the other side secured to the cover 4 either by brazing or by crimping the manifold 3 to the cover 4.

The heat exchange body 2 is provided with at least one blanking plate 6 which helps to delimit ducts through which the second, in particular liquid, fluid flows. The blanking plate 6 comprises at least one orifice 7 through which the second fluid can pass into the heat exchange body 2. The blanking plate 6 may also have a deformation that forms a bulge 8 with respect to a plane of extension of the blanking plate 6. Such a bulge makes it easier to distribute the second fluid over the entire width of the heat exchange body 2. In the particular example of FIG. 1, the blanking plate 6 comprises two bulges 8 and two orifices 7 formed at the bulges, a first orifice being able to allow the second fluid to enter the heat exchange body 2 while a second orifice is able to allow the second fluid to exit the heat exchange body 2.

The blanking plate 6 comprises at least one tongue 9 that is folded against and brazed to a face of a tube bordering the heat exchange body 2.

According to the exemplary embodiment, the blanking plate has two sets of three tongues with the references 9, 10, and 11, each of the sets protruding from one edge of the blanking plate that is parallel to the tube.

The manifold 3 is thus secured to the blanking plate 6 by means of one end of a double-thickness wall of the manifold 3 that is brazed to the blanking plate. This manifold 3 is also secured, in particular by brazing, to a wall of the end tubes placed at the ends of the heat exchange body 2.

FIG. 2 is a view of the heat exchange body 2, in cross section passing through a plane A shown in FIG. 1.

The heat exchange body 2 comprises a plurality of tubes 12 secured to the manifold by brazing. These tubes are produced, for example, from a metal sheet folded on itself so as to delimit an internal volume in which the first, in particular gaseous, fluid flows. It will be noted that the structure of each tube 12 is identical, the two tubes placed at one and the other of the ends of the heat exchange body 2 being referred to as end tubes 12*a* and 12*b* below.

A tube 12 is delimited by two parallel longitudinal walls, with the references 14 and 15, that are joined by two lateral walls with the references 16 and 17. This structure applies to all the constituent tubes 12 of the heat exchange body 2, including the end tubes 12*a*, 12*b*.

Installed inside the internal volume of each tube is an insert 13. The latter has a first function which consists in disrupting the flow of the first fluid in the tube 12 so as to maximize the transfer of heat between the first fluid and the walls delimiting the tube 12. This insert 13 may have a second function which consists in mechanically reinforcing the tube 12. Specifically, the zigzag shape of the insert makes it possible to provide lines of braze between an internal face of the longitudinal walls 14, 15 and the peak of each undulation of the insert 13. The latter thus extends in a rectilinear manner between each internal face of these longitudinal walls, thereby avoiding swelling of the tube 12 under the effect of the pressure of the first fluid.

The heat exchange body 2 also comprises a multiplicity of ducts 18 that are able to channel the second fluid. These ducts 18 are formed by a space formed between each tube, but they are also delimited by a first blanking plate 6*a* and by a second blanking plate 6*b*, which laterally close the heat exchange body 2. The first fluid is thus separated from the second fluid only by the longitudinal walls 14, 15 which form the tubes 12.

The space between each tube 12 is generated by a spacing device 19, one of the functions of which is to ensure a defined distance between two adjacent tubes 12 so as to form the duct 18 in question.

This spacing device 19 may implement a second function which consists in creating turbulence in the second fluid inside the ducts 18, so as to increase the exchange of heat between the second fluid and the longitudinal walls 14, 15 of the tubes 12.

According to one implementation example, the spacing device 19 may be formed by a plurality of deformations provided in the longitudinal walls 14, 15 of the tubes 12. Alternatively, this spacing device 19 may be implemented by one or more attached parts installed between each tube prior to a brazing operation. According to one exemplary embodiment, this part may be a grating, in particular comprising undulations for generating turbulence.

The spacing device 19 may also fulfill a third function which consists in absorbing mechanical forces so as to avoid deformations of the heat exchange body 2. In this way, the spacing device 19 can be brazed to each longitudinal wall 14, 15 of two immediately adjacent tubes 12.

The heat exchange body 2 comprises the first blanking plate 6*a* and the second blanking plate 6*b*, each blanking plate being secured to the lateral wall 16, 17 of each tube 12. Such securing is ensured by brazing of the blanking plate to the lateral wall of the tubes 12.

FIG. 2 clearly illustrates the presence of the tongues 10 formed integrally from the material of the blanking plate 6*a* and 6*b*. These tongues are folded against an external face of the longitudinal wall 14 of the end tubes 12*a* and 12*b*. These tongues reinforce the mechanical connection by brazing between the blanking plates 6*a*, 6*b* and the end tubes 12*a*, 12*b* so as to form a casing delimiting the multiplicity of ducts 18.

FIG. 3 is a view showing in detail the fixing between the cover 4, the manifold 3 and the blanking plate 6. This depiction illustrates a cross section taken in the plane B shown in FIG. 1.

The manifold 3 comprises a base plate 20 surrounded by a fixing edge 21. The base plate 20 is provided with openings, having in this case an elongate shape, which receive one end of each tube 12. These openings can be provided with a collar which is oriented for example toward the heat exchange body 2 or toward the cover 4.

The fixing edge 21 forms a peripheral belt around the base plate 20, this fixing edge preferably being formed integrally from the material of the base plate.

According to the invention, this fixing edge 21 is formed by a double-thickness wall 22, the latter ending at one end 23 at least partially fixed to one and/or the other of the blanking plates 6.

The term "double-thickness" means that the fixing edge 21 is reinforced by the provision of two thicknesses of walls pressed against one another. The double-thickness wall 22 is thus formed by a first wall 24 and by a second wall 25 immediately adjacent to the first wall 24, following the contours thereof. The second wall 25 is at least partially secured to the first wall 24 by a braze between these two walls.

According to an exemplary embodiment shown in this figure, the first wall 24 is also secured to the second wall by means of a fold 36. In such a case, the first wall 24 and the second wall 25 are produced from one and the same metal sheet which has been folded at the fold 36 in order to press the second wall 25 against the first wall 24. Thus, the second wall 25 is considered to be formed integrally from the material of the first wall 24.

Alternatively, the second wall 25 may be a separate part from the first wall 24 and attached before being brazed to the latter, so as to form the double-thickness wall 22 once they have been secured together, in particular by brazing.

In order to simplify the way in which the manifold 3 is manufactured, a thickness of the double-thickness wall 22 is at least twice as large as a thickness of the base plate 20. More precisely, the thickness of the double-thickness wall 22 is strictly equal to twice the thickness of the base plate 20. The thickness of the double-thickness wall 22 is measured in a plane passing through the base plate 20, while the thickness of the latter is measured in a direction parallel to a longitudinal direction of the tubes 12.

According to the exemplary embodiment in FIGS. 3 and 4, the fixing edge 21 at least partially delimits a housing 26 for receiving a heel 27 of the cover 4. For its part, the base plate 20 is extended by a band 28 which extends in a direction perpendicular to the plane of extension of the base plate 20.

The housing 26 which receives the heel 27 of the cover is thus bordered on one side by the band 28 and on the other by the first wall 24 of the double-thickness wall 22.

In addition to receiving the heel 27 of the cover 4, this housing 26 can receive a seal 43 that provides sealing between the first fluid and the surroundings of the heat exchanger according to the invention. This seal 43 thus bears against the heel 27, against the band 28 and against the first wall 24 in the region of the housing 26.

According to the exemplary embodiment in FIG. 3, the first wall 24 comprises a first strip 29 extended by a first side wall 30. The first strip 29 forms the base of the housing 26 against which the seal 43 bears. The first side wall 30 extends at least partially in line with the housing 26, in particular laterally thereto. The first strip 29 and the first side wall 30 are in particular flat.

Located between the first strip 29 and the first side wall 30 is a chamfer 31, that is to say a substantially flat edge that is inclined with respect to the first strip 29 and with respect to the first side wall 30. This chamfer 31 thus connects the first strip 29 to the first side wall 30, this chamfer being an element involved in the mechanical reinforcement of the double-thickness wall 22.

The second wall 25 of the double-thickness wall 22 comprises a second strip 32 extended by a second side wall 33. The second strip 32 extends in a plane parallel to the plane of extension of the first strip 29, these two strips being secured together by a brazed connection.

The second side wall 33 extends in a plane parallel to the plane of extension of the first side wall 30 and is brazed to the latter.

The second strip 32 is joined to the second side wall 33 by a fillet 34, that is to say an edge with a rounded section. This fillet 34 is opposite the chamfer 31 and is configured so as to be separated from this chamfer 31, such an arrangement helping to increase the mechanical strength of the double-thickness wall 22. The second strip 32 and the second side wall 33 are for example flat.

Thus, the double-thickness wall 22 comprises a mechanical reinforcement device arranged at a corner of this double-thickness wall. This mechanical reinforcement device may be formed either only by the chamfer 31 or only by the fillet 34. The mechanical reinforcement device could also be produced by the combination of this chamfer 31 with the fillet 34, such a combination also making it possible to increase the mechanical strength of the double-thickness wall 22.

The end 23 of the double-thickness wall 22 is formed by an end part of the second strip 32. At the manifold 3, the blanking plate 6 is interposed between the lateral walls 16, 17 of the tubes 12 and this end 23. According to an exemplary embodiment that is not shown, it is one edge of the second strip 32 which is brazed to the blanking plate 6.

In the example in FIG. 3, the end 23 comprises a bend 35 oriented such that one or the other of the faces delimiting the second strip 32 bears against and is brazed to the blanking plate 6. In the present case, the bend 35 forms an angle of 90° turned toward the heat exchange body 2, that is to say away from the cover 4 fixed to the manifold 3 in question.

At the fold 36, the double-thickness wall 22 comprises a number of crimping tabs 37 formed by portions which extend the first wall 24. In this figure, these crimping tabs 37 are shown before being folded over the heel 27 of the cover 4. In the final assembly position, these crimping tabs are pressed against the heel 27 of the cover 4 so as to exert a compressive force against the seal 43.

FIG. 4 is a view showing in detail the fixing between the cover 4, the manifold 3 and one of the end tubes 12*a* or 12*b*. This depiction illustrates a cross section taken in the plane C shown in FIG. 1. The differences with respect to FIG. 3 will be described and reference will be made to the description given with respect thereto in order to implement the structure of the elements in common that are shown in FIG. 4.

The base plate 20 comprises in this case collars 38 that are turned toward the heat exchange body 2. These collars receive one end of each tube 12, thereby forming a contact zone improving the brazing between the base plate 20 and the tubes 12.

The band 28 is in this case separated from the longitudinal wall 14 of the end tube 12*a* on account of the presence of a collar.

The second wall 25 is terminated by an edge 39 secured to the end tube 12*a*, for example by brazing between these two parts. The edge 39 comprises a bend 35 which makes it possible to press one face of the second wall 25 against an external face of the longitudinal wall 14 of the end tube 12*a*.

For the variant in FIGS. 3 and 4, it will be noted that the heat exchange body and the manifold can be produced from an aluminum alloy. For its part, the cover 4 can be produced from an aluminum alloy or a synthetic material, such as plastics material for example.

FIG. 5 shows a variant embodiment of the heat exchanger, viewed in a cross-sectional plane illustrated by the reference B in FIG. 1. For FIGS. 3 and 4, the cover 4 is held in the manifold 3 by folding of crimping tabs. The variant in FIG. 5 shows a different assembly in that the cover 4 is secured to the manifold 3 by a weld or at least a braze. For the elements shown in an identical manner, reference will be made to the description relating to FIG. 3.

The housing 26 in this case receives the heel 27 of the cover 4, this heel then being fixed to the double-thickness wall 22 according to two alternative or complementary fixing variants, both of which are shown in this FIG. 5.

The first fixing alternative resides in brazing carried out between the heel 27 and the fixing edge 21 of the manifold 3. First brazing, with the reference 40, is carried out between the band 28 and an internal face of the heel 27 while second brazing 41 is carried out between an external face of the heel 27 and the double-thickness wall 22. By way of example, this second brazing 41 is carried out between the first constituent side wall 30 of the first wall 24 and the external face of the heel 27.

The second fixing alternative is formed by a weld bead, with the reference 42, disposed for example between the heel 27 of the cover and the fold 36 connecting the first wall 24 to the second wall 25 of the double-thickness wall 22.

In the scope of the two fixing alternatives presented in FIG. 5, the heat exchange body 2 and the cover 4 can be produced from an aluminum alloy, thereby making it easier to recycle the heat exchanger without needing to disassemble it.

The above-described heat exchanger 1 can be incorporated into a system for cooling intake gases or exhaust gases of an internal combustion engine. In such a case, the first fluid is formed by the intake gases or exhaust gases of the internal combustion engine, while the second fluid is formed by a liquid cooling fluid.

The invention claimed is:

1. A heat exchanger (1) comprising a heat exchange body (2), at least one cover (4) and a manifold (3) connecting the cover (4) to the heat exchange body (2), the heat exchange body (2) being delimited by at least one blanking plate (6, 6*a*, 6*b*), the manifold (3) comprising a base plate (20) surrounded by an edge (21) for fixing the cover (4), wherein the fixing edge (21) is formed by a double-thickness wall (22), one end (23) of which is at least partially fixed to the blanking plate (6, 6*a*, 6*b*), and wherein the end (23) of the double-thickness wall (22) comprises a bend (35) positioned such that the end (23) extends in a direction opposite a remainder of the double-thickness wall (22), and wherein the heat exchange body (2) comprises a plurality of tubes (12, 12*a*, 12*b*) secured to the manifold (3) and configured to channel a first fluid, and also a multiplicity of ducts (18) configured to channel a second fluid, the ducts (18) being formed between the tubes (12, 12*a*, 12*b*) and delimited by at least the blanking plate (6, 6*a*, 6*b*).

2. The exchanger (1) as claimed in claim 1, wherein a thickness of the double-thickness wall (22) is at least twice as large as a thickness of the base plate (20).

3. The exchanger (1) as claimed in claim 1, wherein the double-thickness wall (22) is formed by a first wall (24) and a second wall (25) brazed to the first wall (24).

4. The exchanger (1) as claimed in claim 3, wherein the double-thickness wall (22) comprises at least one corner at which a mechanical reinforcement device is formed.

5. The exchanger (1) as claimed in claim 4, wherein the mechanical reinforcement device is a chamfer (31) formed at the corner of the first wall (24).

6. The exchanger (1) as claimed in claim 5, wherein the mechanical reinforcement device is a fillet (34) formed at the corner of the second wall (25), the fillet (34) being formed in particular opposite the chamfer (31).

7. The exchanger (1) as claimed in claim 3, wherein the fixing edge (21) at least partially delimits a housing (26) for receiving a heel (27) of the cover (4), the housing (26) furthermore being delimited by a band (28) which peripherally extends the base plate (20).

8. The exchanger (1) as claimed in claim 7, wherein the first wall (24) of the double-thickness wall (22) comprises a first strip (29) forming a base of the housing (26) and a first side wall (30) laterally delimiting the housing (26), the first strip (29) and the first side wall (30) being connected by a chamfer (31).

9. The exchanger (1) as claimed in claim 8, wherein the second wall (25) of the double-thickness wall (22) comprises a second strip (32) brazed to the first strip (29) and a second side wall (33) brazed to the first side wall (30), the second strip (32) and the second side wall (33) being connected by a fillet (34) at a distance from the chamfer (31).

10. The exchanger (1) as claimed in claim 3, wherein the end (23) of the double-thickness wall (22) is positioned such that one face of the second wall (25) of the double-thickness wall (22) is brazed to the blanking plate (6, 6*a*, 6*b*).

11. The exchanger (1) as claimed in claim 1, wherein the multiplicity of ducts (18) is closed by a first blanking plate (6*a*) and by a second blanking plate (6*b*), each blanking plate (6*a*, 6*b*) being secured to a lateral wall (16, 17) of each tube (12, 12*a*, 12*b*).

12. The exchanger (1) as claimed in claim 1, wherein one edge (39) of the double-thickness wall (22) is fixed at least to a longitudinal wall (14) of an end tube (12*a*, 12*b*) of the heat exchange body (2).

13. The exchanger (1) as claimed in claim 12, wherein the blanking plate (6, 6*a*, 6*b*) comprises at least one tongue (9, 10, 11) that is folded against and brazed to the longitudinal wall (14) of the end tube (12*a*, 12*b*).

14. The exchanger (1) as claimed in claim 1, wherein the blanking plate (6, 6*a*, 6*b*) comprises at least one orifice (7) through which a second fluid is able to enter or exit the heat exchange body (2).

15. The exchanger (1) as claimed in claim 1, wherein a thickness of the double-thickness wall (22) is at least twice as large as a thickness of the base plate (20).

* * * * *